US007727129B1

(12) United States Patent
Goddard

(10) Patent No.: US 7,727,129 B1
(45) Date of Patent: Jun. 1, 2010

(54) DUAL LIFT APPARATUS

(76) Inventor: Danny Jay Goddard, 5025 N. Central Av., #243, Phoenix, AZ (US) 85012

( * ) Notice: Subject to any disclaimer, the term of this patent is extended or adjusted under 35 U.S.C. 154(b) by 409 days.

(21) Appl. No.: 11/349,514

(22) Filed: Feb. 6, 2006

(51) Int. Cl.
*A63B 21/072* (2006.01)
*A63B 21/078* (2006.01)

(52) U.S. Cl. ..... 482/104; 482/106; 482/135; 482/142

(58) Field of Classification Search ..... 482/17, 482/38, 92–98, 100–104, 106, 135, 138, 482/44, 906, 907, 142; 434/247, 258; 601/23, 601/24, 33, 40; D21/673, 676, 679
See application file for complete search history.

(56) References Cited

U.S. PATENT DOCUMENTS

| | | | | |
|---|---|---|---|---|
| 3,257,111 | A * | 6/1966 | Martin | 482/98 |
| 3,612,523 | A * | 10/1971 | Glynn | 482/98 |
| 3,640,525 | A | 2/1972 | Proctor | |
| 4,369,966 | A | 1/1983 | Silberman et al. | |
| D284,780 | S | 7/1986 | Brentham | |
| 4,729,561 | A | 3/1988 | Desjardins | |
| 4,909,504 | A * | 3/1990 | Yang | 482/112 |
| 4,955,604 | A | 9/1990 | Pogue | |
| 5,082,260 | A | 1/1992 | Dinelli | |
| 5,184,992 | A * | 2/1993 | Banks | 482/104 |
| 5,348,523 | A | 9/1994 | Blount | |
| 5,509,876 | A | 4/1996 | Reyes | |
| 5,626,539 | A | 5/1997 | Piaget et al. | |
| 5,989,164 | A | 11/1999 | Kullman et al. | |
| 6,299,568 | B1 * | 10/2001 | Prok | 482/104 |
| 6,443,877 | B1 * | 9/2002 | Hoecht et al. | 482/103 |
| 6,659,923 | B2 * | 12/2003 | Teuscher | 482/142 |
| 6,685,601 | B1 | 2/2004 | Knapp | |
| 2006/0264305 | A1 * | 11/2006 | Klassen | 482/99 |
| 2007/0155597 | A1 * | 7/2007 | Hockemeyer | 482/99 |

FOREIGN PATENT DOCUMENTS

| | | | |
|---|---|---|---|
| CA | 1288790 C | * | 9/1991 |
| DE | 4107065 A1 | * | 9/1992 |

OTHER PUBLICATIONS

Schwarzenegger, Arnold, Encyclopedia of Modern Bodybuilding with Bill Dobbins, Machine Presses, p. 302, First Fireside Edition, 1987, Simon and Schuster, NY, NY.*
Parrillo, The Hardcore Advantage, The Smith Machine—651, p. 30, catalog received in the USPTO, Sep. 1995.*

* cited by examiner

*Primary Examiner*—Nicholas D Lucchesi
*Assistant Examiner*—Victor K Hwang
(74) *Attorney, Agent, or Firm*—Schmeiser, Olsen & Watts LLP

(57) ABSTRACT

A dual lift apparatus is provided for use by up to two people to perform the same lifts and exercises simultaneously. The apparatus includes a frame, guide rods, weight guides and a weight bar. The guide rods are coupled vertically within the frame and the frame provides support for the weights to be lifted. The weight guide is operatively coupled to the guide rods, the weight guide having rollers and a lock device to allow the weight guide to move along a length of the guide rods and also to be locked at a particular position on the guide rods. The weight bar is coupled to the weight guide and provides the weight to be lifted by users. The apparatus may also include at least two benches to allow up to two people to use the apparatus simultaneously and each bench is independently adjustable to accommodate different sized users.

15 Claims, 3 Drawing Sheets

DUAL LIFT APPARATUS

BACKGROUND OF THE INVENTION

1. Technical Field

This invention relates generally to weight lifting apparatuses and more particularly to a dual weight lifting apparatus for use by two people simultaneously.

2. State of the Art

There are various machines available for weight training. These machines often have a strict range of motion which the user has to follow in order to lift the weights. This is beneficial to a user of the machine by allowing the user to more easily isolate and target specific muscles and muscle groups. Free weights allow the user to better develop the muscle groups and is essential for advanced weight training. Particular machines provide a combination of a machine with free weights, allowing the user to adjust the weight and receive some benefits of free weights, while retaining the structure and form of the machines. An example of a conventional machine that accomplishes this is commonly referred to as a Smith Machine.

The conventional machines restrict the movement of the weights along a bar that is fixed vertically within a frame. The frame supports the weights and mechanism that allow movement of the weights. These conventional machines however have two particular limitations.

First, the machines are restricted to use by a single user at a time. This restriction to a single user provides limitations, particularly for a person who has suffered an injury, wherein muscles have been weakened by causes such as atrophy or have lost use of particular muscles such as pectoralis, deltoids and biceps, as well as for people who have particular physical disabilities, such as amputees and those with special needs. They are unable to perform weight lifting exercises alone and need the benefit of another person to assist them. Additionally, the ability for two people to use the same machine simultaneously provides comradery and motivation to extend greater effort for each person, regardless of whether it is a person with an injury, who is disabled or who desires to perform two person lifts.

Second, the conventional machines' mechanisms for allowing movement are limited to linear bearings. The bearings have a limited life before repair or replacement is needed, the travel of the weights and movement mechanisms are limited in the smoothness of travel and they are only useable on round guide rods that have hardness greater than the hardness of the bearings. Additionally, as the bearings wear, the machines often have a problem with one side of the bar traveling more smoothly than the other side, causing the bar to angle upon lifting it and further not allowing the bar to turn, thereby restricting proper motion of the machine and compromising the intended exercise being performed.

Accordingly, there is a need in the field of weight lifting for an improved weight lifting apparatus.

DISCLOSURE OF THE INVENTION

The present invention relates to a dual lift apparatus wherein the apparatus allows two people to perform the same lifts and exercises together and simultaneously. The apparatus is generally of a type that restricts the lifting motion to a path defined by the structure of the apparatus.

An aspect of the present invention includes a dual lift apparatus for use by two people for lifting weights simultaneously, the apparatus comprising a frame, at least two guide rods coupled substantially vertical within the frame, and at least two weight guides, each weight guide operatively coupled to at least one guide rod and configured to support a weight bar, wherein each of the at least two weight guides comprise at least two rollers, the roller engaging the guide rods to provide movement of the weight guides and weight bar along the guide rods.

Another aspect of the present invention includes a dual lift apparatus for use by up to two people for lifting weights simultaneously, the apparatus comprising a frame, at least two guide rods coupled substantially vertical within the frame, and at least two weight guides, each weight guide operatively coupled to at least one guide rod and configured to support a weight bar, wherein the frame has a length defined by the distance between the at least two guide rods, the length being within a range of approximately 80 to 130 inches.

Yet another aspect of the present invention includes a dual lift apparatus for use by two people for lifting weights simultaneously, the apparatus comprising a frame, at least two guide rods coupled substantially vertically within the frame, and at least two weight guides, each weight guide operatively coupled to a single guide rod and configured to support a weight bar, wherein the weight bar has a length within a range of approximately 125 to 180 inches.

In another aspect of the invention, independent or dual benches are used. Each bench is independently adjustable in the height to compensate for users having different arm lengths and/or chest thicknesses.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As a preface to the detailed description, it should be noted that, as used in this specification and the appended claims, the singular forms "a," "an" and "the" include plural referents, unless the context clearly dictates otherwise. Further, as used herein, "simultaneous" means performance of the same lift, at the same time by at least two users of an apparatus according to embodiments of the present invention.

As discussed above, embodiments of the present invention relate to a dual lift apparatus wherein the apparatus allows up to two people to perform the same lifts and exercises simultaneously, the apparatus restricting the lifting motion to a path defined by the structure of the apparatus. Generally, the apparatus comprises a frame, at least two guide rods, at least two weight guides and a weight bar.

Figure 1:
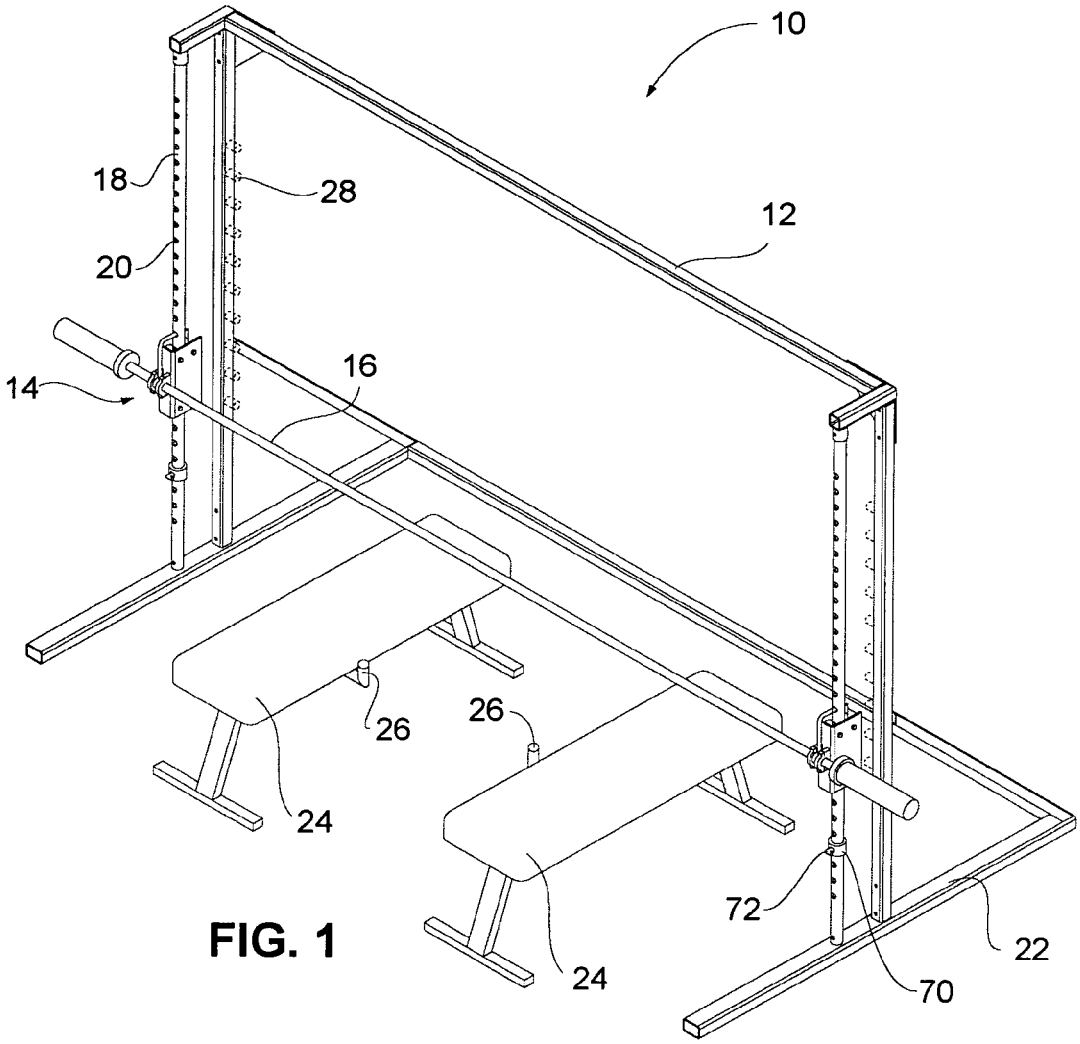
FIG. 1 is a perspective view of a dual lift apparatus, in accordance with embodiments of the present invention.
Figure 2:
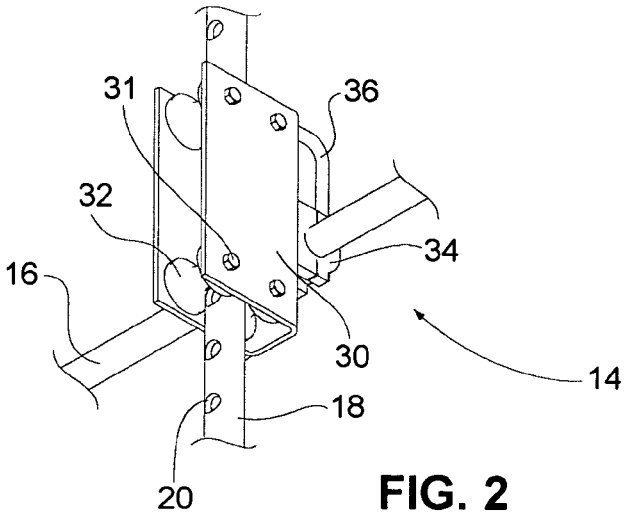
FIG. 2 is a perspective view of a weight guide of a dual lift apparatus, in accordance with embodiments of the present invention.

As shown in FIGS. 1 and 2, particular embodiments of the present invention comprise a dual lift apparatus 10. The apparatus 10 comprises a frame 12, the frame having a base 22 to support the frame 12, at least two guide rods 18, at least two weight guides 14 and a weight bar 16. The guide rods 18 are coupled substantially vertical within the frame 12. The weight guides 14 are each operatively coupled to at least one guide rod 18 and configured to support the weight bar 16. Each of the weight guides 14 comprise at least two rollers 32, the rollers 32 engaging the guide rods 18 to provide movement of the weight guides 14 and weight bar 16 along the guide rods 18. The weight guides 14 may further comprise a case 30, a weight bar receiver 34 and a lock device 36. The rollers 32 may be coupled within the case 30 by use of fasteners 31. The weight bar receiver is coupled to the case 30 and is configured to couple to the weight bar 16, while allowing the weight bar 16 to rotate about its axis. The lock device 36 may be configured to engage apertures 20 of the guide rod 18 to lock the weight guide 26 in place. The lock device 36 may further be configured to lock onto lock bars 28 of the frame 12.

It will be understood that the shape of the guide rods 18 may be various shapes in cross section, such as, but not limited to, circular, rectangular and square. The shape of the guide rods 18 further determines the shape of the rollers 32, wherein the roller 32 are cylindrical with the axis of the cylinder being the axis of rotation and are adapted to properly correspond to the shape of the guide rod 18. For example, and not as a limitation, for circular guide rods 18, the roller 32 may have an outer surface with a substantially equal radius of curvature to correspond to the radius of the cross section circle of the guide rod 18 to provide proper contact between the rollers 32 and the guide rods 18. For additional example and not as a limitation, for square guide rods 18, the rollers 32 may have a substantially linear outer surface wherein the roller corresponds to a side of the square shaped guide rod 18. Additionally, while particular embodiments of the present invention use at least two rollers 32, other embodiments may use different amounts of rollers 32, such as, but not limited to three rollers and four rollers. It is also contemplated that while particular embodiments of the present invention have weight guides 14 with rollers 32, other embodiments may have weight guides 14 that do not use rollers 32 for movement.

The frame 12 may be of a size and shape to allow two users to use the apparatus 10 simultaneously. In particular embodiments of the present invention, the frame 12 may have a length defined by the distance between each guide rod 18, the length being within a range of approximately 80 to 130 inches. The length of the weight bar 16 may be within a range of approximately 125 to 180 inches. In other embodiments of the invention, the weight bar 16 may have a length range of approximately 135 to 150 inches. Further still, in other embodiments of the invention, the frame may have a length of approximately 93 inches.

The apparatus 10 may further comprise at least two benches 24. The benches 24 enable up to two users to perform certain types of lifts that require a bench for proper positioning and exercising of the muscles. The benches 24 may further comprise at least one moveable securable handle 26, wherein the handle 26 provides support for a user who is lifting with one hand. The handle 26 may be gripped with one hand of the user while the other hand is gripping the weight bar 16. As the user lifts the weight with one hand and arms, the handle 26 may be used for balancing on the bench and supporting the user as he or she lifts. This is particularly beneficial for two users who are each lifting the bar 16 simultaneously with one hand. They may each support themselves and provide proper lifting of the weight bar 16. It will be understood by those of ordinary skill in the art that the handle 16 may be located on either side of the bench 24 or on both sides of the bench 24.

The weight bar 16 may be configured to receive and retain standard free weight plates. It will be understood that various types of plates may be used, such as, but not limited to, Olympic weight plates or another weight plates, wherein the hole for receiving the bar is of any size and the bar 16 may be adapted for use with any size weight plate. Also, the weight bar 16 may be of any shape cross section, such as, a circle, oval, square, pentagon, hexagon, octagon or any other rectilinear shape, so long as the weight bar functions in accordance with the present invention. Further, the weight bar 16 may be of a size and shape to extend across the entire frame 12 and may be formed of a material of sufficient strength so as to maintain its shape with large amounts of weights coupled on each end of the weight bar 16. In particular embodiments of the present invention, the apparatus 10 may use stacked weights that are lifted in place of the free weight plates. These particular embodiments would allow a user to lock a particular amount of weight using a pin coupled to a bar retaining the weights, wherein the pin allows only the selected amount of weight to be lifted. These particular embodiments may further include a pulley system with cables to couple the weight bar 16 to the weight stacks.

Figure 3:
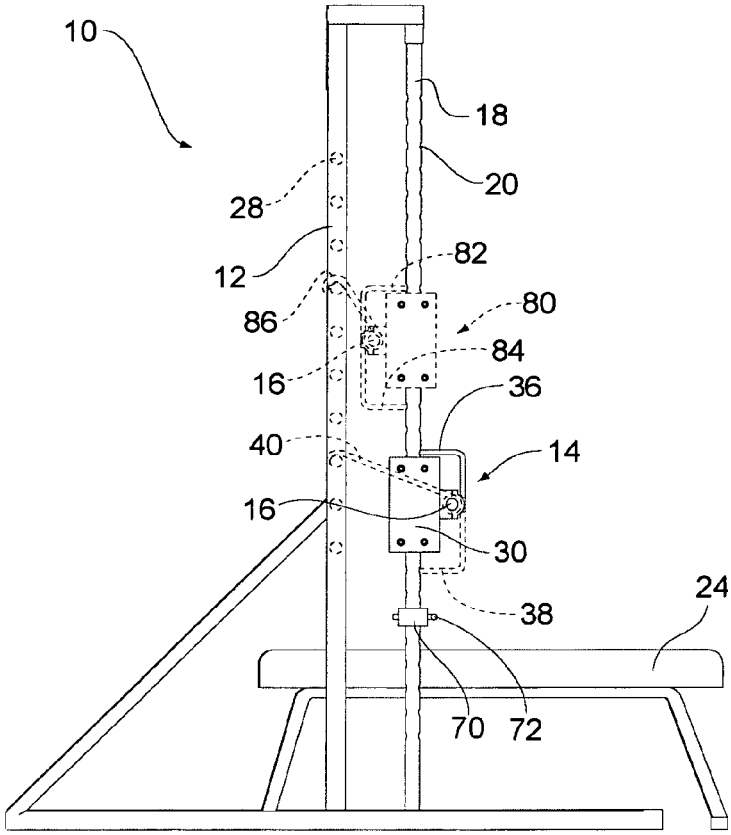
FIG. 3 is a side view of a dual lift apparatus, in accordance with embodiments of the present invention.

Referring further to the drawings, FIG. 3 depicts a side view of a dual lift apparatus 10 according to embodiments of the present invention. The apparatus 10 comprises a frame 12, a guide rod 18 and a weight guide 14. The weight guides 26 comprise a lock device 36 that correspond to apertures 20 in guide rod 18. The lock device 36 is moveable between a locked position and an unlocked position, wherein in the locked position, the lock device 36 engages the apertures 20 of the guide rod 18 and in the unlocked position, the lock device is disengaged from the apertures 20 of the guide rod 18. In particular embodiments, the lock device 36 is moved between the locked and unlocked position by manual rotation of the weight bar 16, thereby rotating the lock device 36. It will be understood by those of ordinary skill in the art that the lock device 36 is not limited to engaging the apertures 20, but may lock in other ways such as, but not limited to engaging the frame 12, engaging a lock bar and engaging the rollers of the weight guide 14 directly to impede movement of the weight guide 14 and any other manner of locking the weight guide 14 by action of the user.

For the exemplary purposes of this disclosure, alternative lock devices are shown in FIG. 3. Lock device 38 functions the same as lock device 36, however, lock device 38 engages the apertures 20 above the weight guide 14 while the lock device 36 engages the apertures 20 below the weight guide 14. Further, alternative lock device 40 engages lock bar 28, the lock bar 28 being coupled to the frame 12. In particular embodiments of the present invention, the lock device 36 is manually moved from the lock position into the unlocked position by rotating the weight bar 16, thereby allowing movement of the weight guide 14.

An alternative embodiment of the weight guide 14 is shown in dashed lines as weight guide 80, in accordance with the present invention. The weight guide 80 supports the weight bar 16 between the guide rods 18 and the frame 12. The weight guide 80 comprises a lock device 82 that correspond to apertures 20 in guide rod 18. The lock device 36 is moveable between a locked position and an unlocked position, wherein in the locked position, the lock device 36 engages the apertures 20 of the guide rod 18 and in the unlocked position, the lock device 82 is disengaged from the apertures 20 of the guide rod 18. Alternatively, other lock devices may be used and are also shown in FIG. 3. Lock device 84 functions the same as lock device 82, however, lock device 82 engages the apertures 20 above the weight guide 80 while the lock device 84 engages the apertures 20 below the weight guide 80. Further, alternative lock device 86 engages lock bars 28; the lock bars 28 being coupled to the frame 12. In particular embodiments of the present invention, the lock device is manually moved from the lock position into the unlocked position by rotating the weight bar 16, thereby allowing movement of the weight guide 80.

With further reference to the drawings and particularly to FIGS. 1 and 3, particular embodiments of a dual lift apparatus 10 in accordance with the present invention may further comprise at least two safety locks 70. The at least two safety locks 70 are coupled to the at least two guide rods 18, each safety lock 70 having a lock pin 72, wherein the safety lock 70 is adjustable in height to prevent the weight guides 14 from traveling lower than the position of the safety lock 70 on the guide rod 18. The safety lock 70 is of particular benefit for users who are performing a squat lift, wherein if the user or users are unable to lift the weight, they can lower the weight guide 14 to rest on the safety locks 70. Once the weight guides 14 contact the safety locks 70, the weight guides 14 are unable to move lower and the user or users are able to move safely from under the weight bar 16. It will be understood that the safety lock 70 while of particular benefit during a squat lift, the safety lock 70 may be used in conjunction with all lifts that may be performed on the apparatus 10.

Figure 4:
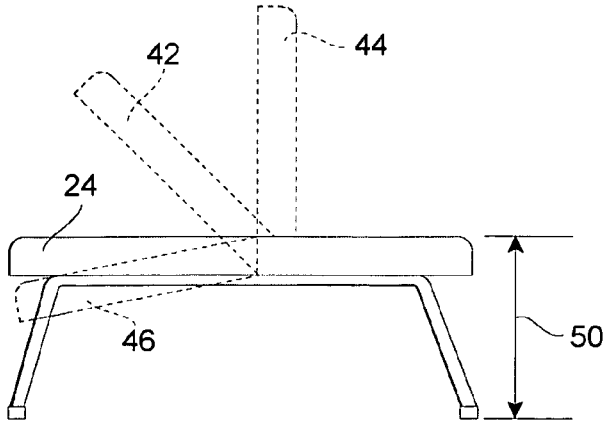
FIG. 4 is a side view of a bench of a dual lift apparatus, in accordance with embodiments of the present invention.

Referring again to the drawings, FIG. 4 depicts a side view of a bench 24 of a dual lift apparatus, according to particular embodiments of the present invention. Each bench 24 of the apparatus may be independently adjustable to account for various sizes of users. For example, and not by way of limitation, the height 50 of the bench may be varied to enable two users of different arm length and/or chest size to use the apparatus simultaneously and have a full range of motion. Various types of benches 24 may be used with the apparatus 10 as shown in FIG. 4, such as, but not limited to a horizontal bench 24, an inclined bench 42, a bench with a vertical back 44 and a declined bench 46. The various types of benches allow users to perform different lifts such as, but not limited to, the horizontal bench 24 may be used for a bench press, the inclined bench 42 for an inclined bench press, the vertical back bench 44 for a shoulder press and/or a behind the neck press, the declined bench 46 for a declined bench press, and/or the bench may be removed completely for lifts such as, but not limited to a dead lift, a squat, an upright row, a front shoulder high pull, a bent over row, a calf raiser, and a shoulder shrug.

Alternatively, the bench 24 may be adjustable between positions to allow a user to perform different lifts. For example, and without limitation, a portion of the bench 24 may be in a substantially horizontal position, an inclined position 42, a substantially vertical position 44 and a declined position 46. The angle of the bench may be varied dependent upon the particular lift to be performed.

It will be understood by those of ordinary skill in the art that the benches 24 may be removably coupled to the frame 12, wherein the benches 24 are still independently adjustable and function in accordance with the present invention. It will also be understood that the benches 24 may be removably coupled together. They benches 24 in this particular configuration would remain independently adjustable.

Figure 5:
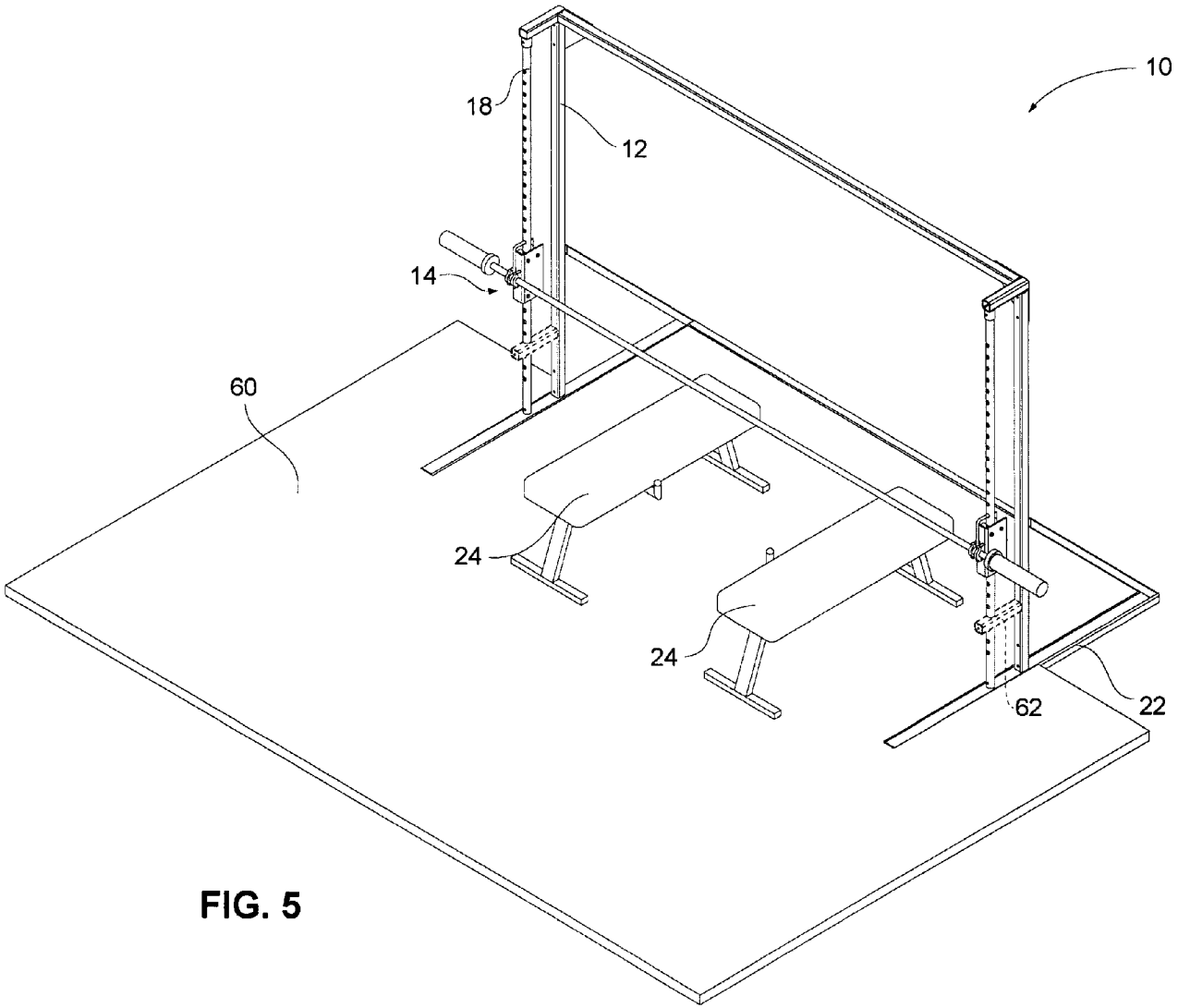
FIG. 5 is a perspective view of a dual lift apparatus with a platform, in accordance with embodiments of the present invention.

With additional reference to the drawings, FIG. 5 depicts a perspective view of a dual lift apparatus 10 of a particular embodiment of the present invention. The apparatus comprises a frame 12, a weight guide 14, a weight bar 16, a guide rod 18 and platform 60. The platform 60 may be removably coupled to a base portion 22 of the frame 12, the platform 60 supporting at least two users of the apparatus 10. The platform 60 may be removable to account for, among other reasons, limited space, and may further be formed of varying sizes and shapes to accommodate placement of the machine various locations. Platforms as of the type of platform 60 are typically used by lifters within a competition. The use of platform 60 may also be used in lifting competitions, but use is not limited strictly to competitions. For example, the users may use benches 24 supported by the platform 60 to perform various lifts that require a bench for performance. Alternatively, the benches may be removed and the users may stand on the platform 60 and perform lifts, such as, but not limited to, a dead lift, a squat, an upright row, a front shoulder high pull, a bent over row, a calf raiser, and a shoulder shrug. The platform 60 is removable dependent on space, and may further be formed of varying sizes and shapes to accommodate placement of the machine various locations.

According to particular embodiments the frame 12 may include stop 62, which limits how low the weight guides 14 may travel on the guide rods 18. In such embodiments, in order to perform a proper dead lift, another removable platform may be placed on top of platform 60 in order for the user to stand on the removable platform and be at the proper level with respect to the weight bar 16 to perform a proper dead lift.

Other particular embodiments of a dual lift apparatus in accordance with the present invention may further comprise a weight rack. The weight rack may coupled anywhere onto the frame of the apparatus, so long as the weight rack does not interfere with the user or weight bar during a lift exercise.

Accordingly, the components defining any embodiment of a dual lift apparatus may be formed of any of many different types of materials or combinations thereof that can readily be formed into shaped objects provided that the components selected are consistent with the intended operation of a dual lift apparatus. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any embodiment of a dual lift apparatus may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/ or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A dual lift apparatus for use by two people for lifting the same weight simultaneously, the apparatus comprising:

a frame;

a weight bar configured for selectively supporting weight plates;

at least two substantially identical and independent benches to support at least two people, each bench positioned directly beneath the weight bar and laterally movable relative to one another to a selected position relative to the frame to permit each person to engage the weight bar from laterally spaced positions, wherein each bench comprises at least one moveable, securable handle located along one side thereof which provides support for a person who is lifting the weight bar with a single limb;

at least two guide rods coupled substantially vertical within the frame; and at least two weight guides, each weight guide operatively coupled to at least one guide rod and configured to support the weight bar, wherein each of the at least two weight guides comprise at least two rollers, the roller engaging the guide rods to provide movement of the weight guides and weight bar along the guide rods, wherein the frame has a length defined by the distance between the at least two guide rods, the length being greater than about 80 inches to accommodate the at least two benches within the frame between the at least two guide rods in a laterally spaced, side by side position to support two people.

2. The apparatus of claim 1, wherein each of the at least two weight guides further comprise a lock device, the lock device being moveable between a locked position and an unlocked position, wherein in the locked position, the lock device engages at least one of the frame and a guide rod and in the unlocked position, the lock device is disengaged from at least one of the frame and guide rod to allow movement of the at least two weight guides.

3. The apparatus of claim 1, wherein the weight bar has a length within a range of approximately 125 to 180 inches.

4. The apparatus of claim 3, wherein the length of the weight bar is within a range of approximately 135 to 150 inches.

5. The apparatus of claim 1, wherein the apparatus is adaptable for various weight lifting exercises including at least bench press, incline bench press, decline bench press, front shoulder press, behind the neck shoulder press, dead lift, squat, upright row, front shoulder high pull, bent over row, calf raiser and shoulder shrug.

6. The apparatus of claim 1, further comprising at least two safety locks coupled to the at least two guide rods, each safety lock having a lock pin, wherein the safety lock is adjustable in height to prevent the weight guides from traveling lower than the position of the safety lock on the guide rod.

7. A dual lift apparatus for use by up to two people for lifting the same weight simultaneously, the apparatus comprising:

a frame;

a weight bar configured for selectively supporting weight plates;

at least two substantially identical and independent benches to support at least two people, each bench positioned directly beneath the weight bar and laterally movable relative to one another to a selected position relative to the frame to permit each person to engage the weight bar from laterally spaced positions, wherein each bench comprises at least one moveable, securable handle located along one side thereof which provides support for a person who is lifting the weight bar with a single limb;

at least two guide rods coupled substantially vertical within the frame; and at least two weight guides, each weight guide operatively coupled to at least one guide rod and configured to support the weight bar, wherein the frame has a length defined by the distance between the at least two guide rods, the length being greater than about 80 inches to accommodate the at least two benches within the frame between the at least two guide rods in a laterally spaced, side by side position to support two people.

8. The apparatus of claim 7, wherein the apparatus is adaptable for various weight lifting exercises including at least bench press, incline bench press, decline bench press, front shoulder press, behind the neck shoulder press, dead lift, squat, upright row, front shoulder high pull, bent over row, calf raiser and shoulder shrug.

9. The apparatus of claim 7, wherein the weight bar has a length within a range of approximately 125 to 180 inches.

10. The apparatus of claim 9, wherein the weight bar has a length within a range of approximately 135 to 150 inches.

11. The apparatus of claim 7, wherein each of the at least two weight guides further comprise a lock device, the lock device being moveable between a locked position and an unlocked position, wherein in the locked position, the lock device engages at least one of the frame and a guide rod and in the unlocked position, the lock device is disengaged from at least one of the frame and guide rod.

12. A dual lift apparatus for use by two people for lifting the same weight simultaneously, the apparatus comprising:

a frame;

a weight bar configured for selectively supporting weight plates;

at least two substantially identical and independent benches to support at least two people, each bench positioned directly beneath the weight bar and laterally movable relative to one another to a selected position relative to the frame to permit each person to engage the weight bar from laterally spaced positions, wherein each bench comprises at least one moveable, securable handle located along one side thereof which provides support for a person who is lifting the weight bar with a single limb;

at least two guide rods coupled substantially vertically within the frame; and at least two weight guides, each weight guide operatively coupled to a single guide rod and configured to support a the weight bar, wherein the weight bar has a length within a range of approximately 125 to 180 inches, wherein the frame has a length defined by a distance between the at least two guide rods, the length being greater than about 80 inches to accommodate the at least two benches within the frame between the at least two guide rods in a laterally spaced, side by side position to support two people.

13. The apparatus of claim 12, wherein the length of the weight bar is within a range of approximately 135 to 150 inches.

14. The apparatus of claim 12, wherein each of the at least two weight guides further comprise a lock device, the lock device being moveable between a locked position and an unlocked position, wherein in the locked position, the lock device engages at least one of the frame and a guide rod and in the unlocked position, the lock device is disengaged from at least one of the frame and guide rod.

15. The apparatus of claim 12, wherein the apparatus is adaptable for various weight lifting exercises including at least bench press, incline bench press, decline bench press, front shoulder press, behind the neck shoulder press, dead lift, squat, upright row, front shoulder high pull, bent over row, calf raiser and shoulder shrug.

* * * * *